United States Patent [19]

Loewenstine

[11] 4,396,027

[45] Aug. 2, 1983

[54] HAIR SPRAY SHIELD

[75] Inventor: Michael M. Loewenstine, Cincinnati, Ohio

[73] Assignee: Spray Shield, Inc., Cincinnati, Ohio

[21] Appl. No.: 360,178

[22] Filed: Mar. 22, 1982

[51] Int. Cl.[3] ..... A45D 1/00

[52] U.S. Cl. ..... 132/9

[58] Field of Search ..... 132/9, 45; 2/9; D28/3, D28/10

[56] References Cited

U.S. PATENT DOCUMENTS

| | | | |
|---|---|---|---|
| 1,524,863 | 2/1925 | Houston | 132/9 X |
| 2,136,039 | 11/1938 | Clancy | 132/9 |
| 3,060,445 | 10/1962 | Brockman | 2/11 |
| 3,602,913 | 9/1971 | Neese | 2/9 |

*Primary Examiner*—Gregory E. McNeill

*Attorney, Agent, or Firm*—Wilson, Fraser, Barker & Clemens

[57] ABSTRACT

A hand held spray shield of an optically transparent material to protect the user's face, eyes, ear, and the like when the user is applying a cosmetic hair spray and any over-spray collecting on the surface of the shield will not run-off onto the hands of the user. The shield is of a form which includes a major shield portion and an ear shield portion separated by a notch configured and demensioned to permit the hair in the temple area to be readily sprayed. The shield portions of the device typically include a frame having a cross-sectional configuration capable of forming, in conjunction with the adjacent shield portion, a trough-like zone for collecting spray.

1 Claim, 4 Drawing Figures

HAIR SPRAY SHIELD

BACKGROUND OF THE INVENTION

The use of atomized cosmetic preparations, such as hair sprays, for example, dispersed from aerosol or pressurized containers, has become widely accepted in recent years. These preparations often times contain ingredients and substituents which are irritating and harmful to the user's eyes and skin.

While a variety of facial masks have been developed to protect the user's face from dust of spray-laden atmospheres, these have generally been unsatisfactory because of their complex configuration and rigid constructions, causing discomfort and irritation to the user's face. As a result, extensive use of such masks has been discouraged.

SUMMARY OF THE INVENTION

The above disadvantages have been overcome by the present invention by the production of a hand held spray shield, typically of an optically transparent material, to protect the user's face, eyes, ears, and the like when the user is applying a cosmetic hair spray.

It is an object of the present invention to produce a hair spray shield which may be easily held in place over the user's facial area to prevent excessive exposure to hair sprays and the like during the application thereof.

Another object of the invention is to produce a hair spray shield which will readily collect any over-spray of the hair spray preparation being applied so as not to effect cosmetics previously applied to the user's face.

Still another object of the invention is to produce a hair spray shield wherein any over-spray of the atomized cosmetic preparation being applied is prevented from coalescing and dripping onto the handle portion of the device and onto the hand of the user.

Still another object of the invention is to produce a hair spray shield which is attractive in appearance, economical to manufacture, and readily maintained in clean condition.

Still another object of the invention is to produce a hair spray shield comprised of a relatively few number of parts and configured for proximate engagement with the user's hair line areas, and is readily formed of durable, long lasting, and relatively inexpensive materials.

Still another object of the invention is to produce a hair spray shield formed of optically transparent material to militate against the impairment of vision during the application of atomized cosmetic preparation to the user's hair.

The above objectives may be typically achieved by a hair spray shield comprising a main shield body portion formed of lightweight substantially rigid sheet material; a handle connected to the body portion; and a frame defining a trough-like reservoir extending along at least the portion of the main shield body portion adjacent the handle to collect any liquid running off from the body portion.

BRIEF DESCRIPTION OF THE DRAWINGS

The above objectives and advantages of the invention will become readily apparent to one skilled in the art from reading the following detailed description of an embodiment of the invention when considered in the light of the attached accompanying drawings in which.

DESCRIPTION OF THE PREFERRED EMBODIMENT

Figure 1:
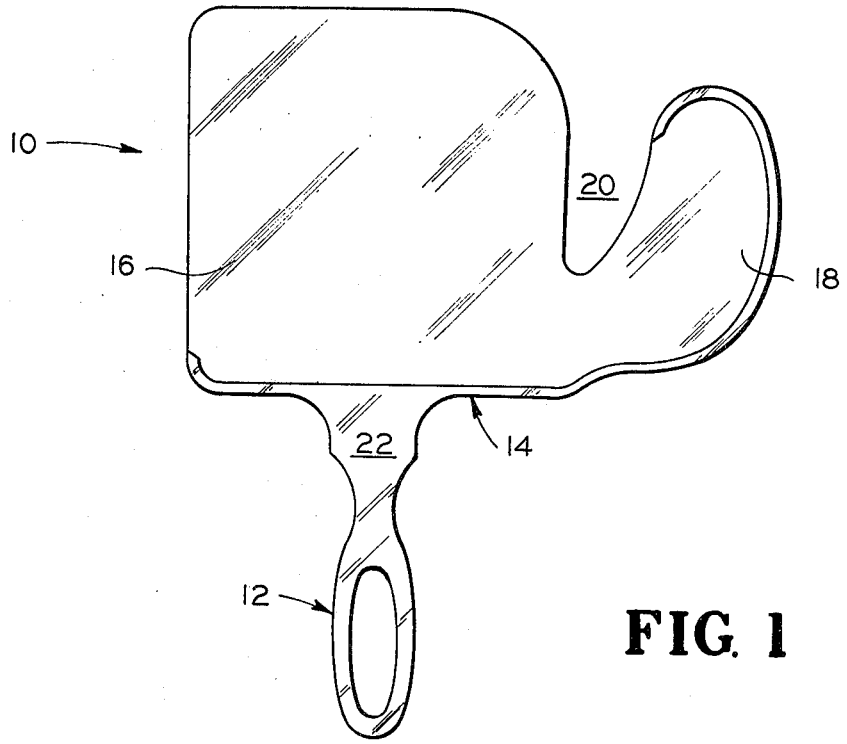
FIG. 1 is a front elevational view of a hair spray shield embodying the features of the invention.
Figure 2:
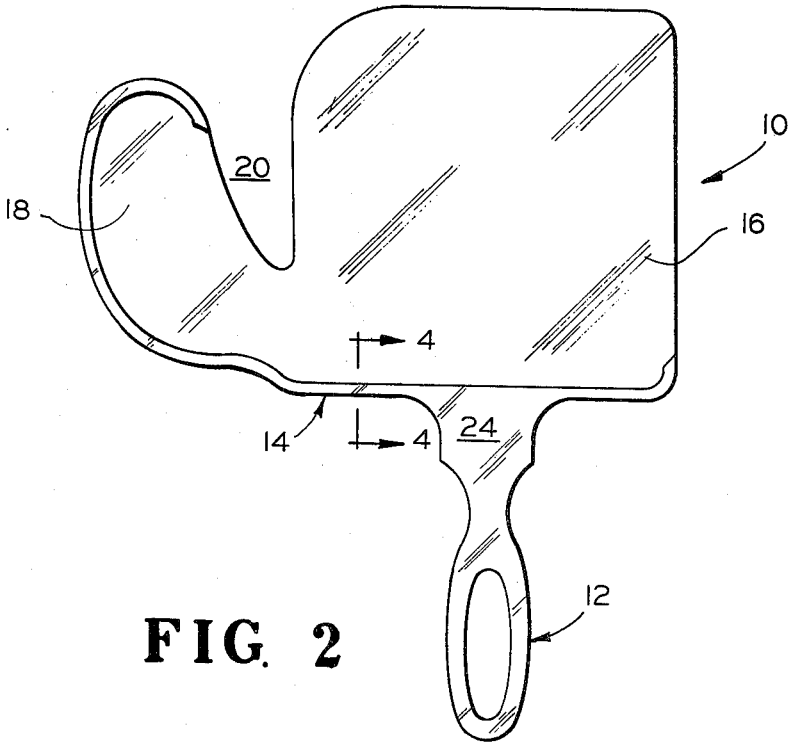
FIG. 2 is a elevational view of the device illustrated in FIG. 1 viewed from the opposite side thereof.
Figure 4:
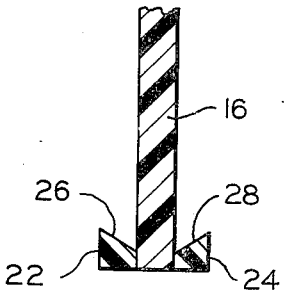
FIG. 4 is an enlarged fragmentary sectional view of the lower frame member of the device illustrated in FIG. 2 taken along line 4—4 thereof.
Figure 3:
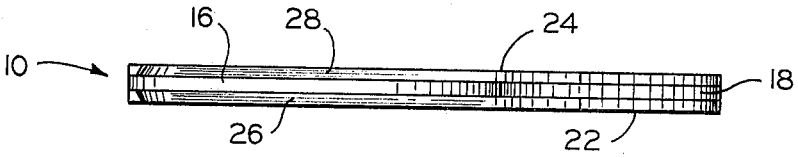
FIG. 3 is a top plan view of the device illustrated in FIG. 1.

Referring to the drawings, there is illustrated a hand held hair spray shield including a main shield body portion, generally indicated by reference numeral 10, a handle portion 12, and a frame member 14 partially surrounding the main shield body portion 10 and integral with the handle 12.

The main body portion 10 includes a major shield portion 16 and a laterally extending ear shield portion 18, commonly spaced from one another by a cut-out portion 20. The main shield body portion 10 is typically formed of an optically transparent plastic sheet material such as plexiglass which is comprised of lightweight, transparent, thermoplastic synthetic resin. Excellent results have been achieved by forming the main panel 10 of a thickness of approximately one-eighth inch.

The main body portion 10 can be satisfactorily formed such that the overall configuration thereof contains the depending handle 12. In completing the handle 12 and the frame 14, two substantially identical elements 22 and 24 are formed and then are positioned on either side of the main shield body blank 10 forming a marginal edge portion on either side of the peripheral portion of the ear shield 18 and along the lower marginal edge portion of the major shield portion 16. Manifestly, the lower portions of the formed elements 22 and 24 extend in superimposed relation on opposing sides of the handle portion 12. Satisfactory results have been achieved by forming the elements 22 and 24 of a lightweight, transparent, thermoplastic synthetic resin which is suitably secured by heat and/or suitable adhesives to the adjacent portion of the main body portion 10.

In certain instances, it has been found that satisfactory and desirable aesthetic aspects of the overall hair spray shield may be achieved by forming the exposed surfaces of the elements 22 and 24 with a matte finish.

An important feature of the invention resides in the configuration of the uppermost surface of the elements 22 and 24 which are formed so as to bevel inwardly toward the adjacent surface of the main body portion 10 to form in cooperation therewith trough-like reservoirs 26 and 28, respectively.

While the above description of the invention has alluded to the device as being formed as three piece composite structure, it will be understood that the device could be formed as a single unitary device.

It is considered that the type of synthetic resin mentioned above is desirable in the formation of the hair spray shield. However, it will be understood that other constituents may be used, such as acrylic resins, for example.

In operation, the device of the invention may be used for forward or frontal spraying by placing the top edge of the major shield portion 16 as close to forehead hair line as possible without actually touching the hair. The shield is then rested on the forehead, although 1/16th inch off the forehead position may provide better results especially when cosmetic protection is desired. The upper portion of the shield handle 12 adjacent its intersection with a major shield portion 16 should be approximately one-half inch from the user's nose. The ear shield portion 18 may be positioned either to the right or to the left in accordance with the desires and preferences of the individual user. At this stage, the hair spray shield is correctly positioned for frontal spraying.

Side spraying may be utilized with the ear shield portion 18 positioned upwardly and thence the upper portion of the major shield portion 16 has moved forward to the hair line of the user, but not in actual contact with the hair. That top portion of the major shield portion 16 should be high enough to prevent any over-spray onto the forehead of the user. While spraying, the major shield portion 16 may be moved downwardly to protect the lower portion of the face of the user. The shield should be held approximately parallel to the user's head and other adjustments may be made to accommodate the user's desires.

When using the ear shield portion 18, the device is placed along side the user's head with the ear shield portion 18 generally covering an ear. The shield device is then adjusted until the outer rim guard 22 or 24 around the periphery of the ear shield portion 18 is touching the top and the back of the user's ear, simultaneously. All of the user's hair in that region should be on the outer rim or frame of the device. The user then adjusts the major shield portion 16 to be disposed approximately three quarters of an inch away from the user's forehead. The base of the major shield portion 16, adjacent the handle portion 12 is disposed generally horizontally. This places the shield device in a correct position for ear protection while spraying.

It will be appreciated that the optical transparent characteristics of the blank 10 permits the user to visually observe the direction of spray and control the distribution thereof. The spray shield will militate against any over-spray contacting sensitive areas of the user and allowing spray to contact the user's hair, only. Any over-spray which may contact the major shield portion 16 or the ear shield portion 18 and fall or run downwardly on the surface thereof, will be collected in the particular trough section 26 or 28 at the base. Since the troughs 26 and 28 are of sufficient capacity, the over-spray collected therein will be prevented from contacting the handle portion 12 and the user's hand.

Excess spray is then removed from the device by holding the entire device under a hot water faucet and excess is then removed by shaking the entire assembly into sink. The device is then wiped clean with a soft cloth to avoid scratching the plastic material and to assure continuing optical transparency for additional use.

In accordance with the provisions of the patent statutes, I have described and explained the structural features and operational aspects of a preferred embodiment of a hair spray shield incorporating the features of my invention. However, it must be understood that various changes in material and structure may be made without departing from the spirit of my invention which is defined in the appended claims.

I claim:

1. A hair spray shield comprising:

(a) a main shield body formed of a flat planar sheet of optically transparent substantially rigid material, said body including a first portion to protect the user's face, and a second coplanar laterally extending portion to protect the user's ear interconnected to the first portion by a third portion of a smaller dimension to define a notched zone between the first and second portions of said body;

(b) a frame extending along at least a portion of said main body and cooperating therewith to form a trough-like reservoir on each of the opposing surfaces of said main shield body extending along the corresponding marginal edges of the first body portion, the second body portion, and the third body portion opposite the notched zone, the reservoirs being parallel and coextensive with one another; and (c) a handle connected to said main body and said frame, said handle being coplanar with said main body and extending away therefrom.

* * * * *